US006299374B1

(12) United States Patent
Naor et al.

(10) Patent No.: US 6,299,374 B1
(45) Date of Patent: Oct. 9, 2001

(54) INSTRUMENTS FOR PRODUCING EDIBLE COLORED INDICIA ON FOOD SUBSTRATES AND MEDICAMENTS

(76) Inventors: David Naor, 37-11 Berdan Ave., Fair Lawn, NJ (US) 07410; James Michael, 14 Hillman Ave., Glen Rock, NJ (US) 07452

( * ) Notice: Subject to any disclaimer, the term of this patent is extended or adjusted under 35 U.S.C. 154(b) by 0 days.

(21) Appl. No.: 09/796,115

(22) Filed: Feb. 28, 2001

Related U.S. Application Data

(60) Provisional application No. 60/188,037, filed on Mar. 9, 2000.

(51) Int. Cl.[7] ..... B43K 5/00; B43K 8/06; B43M 11/06

(52) U.S. Cl. ..... 401/198; 401/202

(58) Field of Search ..... 401/196, 198, 401/199, 202, 207; 106/31.37, 31.42, 31.58

(56) References Cited

U.S. PATENT DOCUMENTS

| | | | | |
|---|---|---|---|---|
| 3,853,797 | | 12/1974 | Pelzig . | |
| 3,993,409 | * | 11/1976 | Hart | 401/199 |
| 4,024,287 | | 5/1977 | Golchert . | |
| 4,344,644 | | 8/1982 | Somogyi . | |
| 4,681,471 | | 7/1987 | Hayduchok et al. . | |
| 4,722,145 | | 2/1988 | Prest . | |
| 5,213,504 | | 5/1993 | Lee et al. . | |
| 5,453,122 | * | 9/1995 | Lyon | 106/31.37 |
| 5,498,645 | | 3/1996 | Mariano et al. . | |
| 5,534,281 | | 7/1996 | Pappas et al. . | |
| 5,746,715 | | 5/1998 | Mazer et al. . | |
| 5,864,909 | | 2/1999 | Liu . | |
| 5,942,444 | | 8/1999 | Rittenburg et al. . | |
| 5,947,624 | | 9/1999 | Davignon . | |
| 5,958,525 | | 9/1999 | Green et al. . | |
| 6,004,121 | | 12/1999 | Gupta . | |
| 6,029,601 | | 2/2000 | Suya . | |
| 6,068,981 | | 5/2000 | Rittenburg et al. . | |
| 6,081,734 | | 6/2000 | Batz . | |
| 6,086,279 | | 7/2000 | Yen . | |

* cited by examiner

*Primary Examiner*—Steven O. Douglas
*Assistant Examiner*—Tuan Nguyen
(74) *Attorney, Agent, or Firm*—Weingram & Associates, P.C.

(57) ABSTRACT

Novel capillary feed marking instruments capable of producing edible colored indicia directly on food substrates and medicaments are disclosed. The marking instruments are used to write or decorate directly on porous and non-porous food substrates in a controlled fashions and without the need to pre-mix colors or handle dyes. Kits comprising a plurality of such marking instruments in various colors and, optionally, edible substances or artistic aids, are also disclosed. The marking instruments of the invention may also be employed in a system for classifying solid, oral medicaments such as pills, tablets or capsules, for identification and easy detection.

45 Claims, 3 Drawing Sheets

INSTRUMENTS FOR PRODUCING EDIBLE COLORED INDICIA ON FOOD SUBSTRATES AND MEDICAMENTS

CROSS REFERENCE TO RELATED APPLICATIONS

This application claims the benefit of U.S. Provisional Application No. 60/188,037 filed Mar. 9, 2000.

BACKGROUND OF THE INVENTION

1. Field of the Invention

The present invention relates to marking instruments which deploy edible coloring liquid on objects and in particular to novel capillary feed marking instruments capable of producing edible colored indicia directly on food substrates and medicaments.

2. Description of the Related Art

Toys, pens, and other devices are available which deploy edible inks onto other objects to label or provide color indicia to other objects.

Certain of these apparatus are constructed and adapted to deploy an edible ink or dye to food products such as bakery goods, cakes, pies, and the like.

For example, conventional cake decorating mediums include gels, icing, or decorative objects. Typically, icing, or gel is available in squeeze tubes with decorative tips. The user may write on or decorate the cake or other food item by squeezing the tube to force colored gel or icing through the desired tip. Food coloring, available in concentrated form in squeeze bottles, cannot be applied directly to a food surface, bleeds uncontrollably, and is extremely messy.

U.S. Pat. No. 4,024,287 to Golchert discloses a process of decorating a food item by transferring a preprinted or original two-dimensional design using moisture to effect the transfer. The process includes placing a sheet of transfer medium. Such as tissue paper, over the design to be traced. The design is traced on the transfer medium (not the food item) using edible ink. Alternatively, the design may be drawn originally on the transfer medium. The transfer medium is then placed on the food item to be decorated with the colored side down, and a damp pad is placed on the back face of the transfer medium. This causes the traced design to become partially dissolved and thereby be transferred to the food item to be decorated. To protect the original picture from the ink used to trace or copy the picture, a shield is placed over the picture before tracing. The user may fill in the transferred design using colored frosting or gels, or may use the two-dimensional design as is.

However among the known apparatus, the construction of the instrument to deploy the edible ink is not adapted for the delicate procedure of depositing the ink in an exacting manner on delicate food such as bakery goods. In Such devices, the ink bleeds and stains uncontrollably. In other known systems and methods, a combination of steps and features are necessary in order to reliably and accurately deposit the ink on the food product. This provides for numerous, unnecessary steps, which in a commercial environment reduces cost effectiveness of marking the product. In addition, where certain of the known devices are used, the plurality of steps to deploy the edible ink on the food product and the additional structural features of the apparatus complicate the marking procedure of the food product, thereby reducing the enjoyment of the marking procedure. When such is the case, it is not uncommon for the dye mark to "bleed" on the food product or to be inaccurately displayed.

There is a need for a device which would enable a user to neatly and without mess decorate food, medicaments, and other comestibles, hereinafter referred to as "food substrates", without the user having to pre-mix or directly contact the dyes used to decorate the food substrate. It would therefore be desirable to have a marker or series of markers in various colors and hues capable of deploying edible food dyes directly onto a food substrate, regardless of the physical consistency of the food substrate, in a reliable accurate manner without involving a series of steps or supporting structures in which to transfer the dye onto the food substrate.

OBJECTS AND SUMMARY OF THE INVENTION

It is therefore an object of the present invention to provide a marker which is a quick, easy and dependable means of decorating food, medicaments, or other comestibles.

A further object of the invention is to provide markers which deploy edible dyes without the need to pre-mix colors or to contact the dyes directly.

Yet another object of the invention is to provide markers which deploy edible dyes in a controlled, no-mess fashion, which are easy to use and store.

Yet a further object of the invention is to provide an edible food dye marking instrument constructed and adapted to deploy a food dye directly on food products of delicate construction or having a soft exterior or interior surface, substantially without damaging the food product or the soft surface.

It is another object of the present invention to provide a marker for deploying an edible food dye in which a composition is deposited or admixed to prevent bacterial growth in the food dye and the food substrate to which the dye is deployed.

It is another object of the present invention to provide a marker having a construction of materials which deploy an edible dye directly on a food substrate without violating government regulations and religious law.

Yet another object is to provide a marker which can be used to write or decorate directly on a food surface.

A further object of the invention is to provide a marker which can apply food grade dye directly to a foodstuff which may have a generally planar or even non-planar surface.

A further object of the invention is to provide a marker which can apply food grade dye directly to a foodstuff which may have a porous or non-porous surface.

Another object of the invention is to provide a system for classifying solid, oral medicaments for identification and easy detection.

In accordance with one embodiment of the invention, a capillary feed marking instrument capable of producing colored indicia directly on a food substrate is provided. The marking instrument comprises an elongated, hollow, cylindrical body having a front end and a rear end. A reservoir within the hollow cylindrical body holds a quantity of an edible coloring liquid. A marking tip extends from the front end of the body and communicates with the reservoir for producing a colored indicia directly on the food substrate. A cap is removably mounted on the front end of the marking instrument to cover the marking tip when not in use. The marking tip comprises a fibrous tip which allows the edible coloring liquid to be reliably and accurately deposited by capillary action directly onto the food substrate. The edible coloring liquid is a non-toxic Food and Drug Administration certified dye. The viscosity and surface tension of the coloring liquid are sufficient to enable the liquid to be drawn out of the marking tip by capillary action and deposited onto the food substrate when the marking, tip is contacted to the food substrate.

Kits are also provided comprising a plurality of marking instruments in a variety of colors for producing colored marks directly on food substrates. Kits may optionally include additional materials, such as, for example, edible substances such as non-printed cookies, pre-printed cookies, cake, bread, fruits, vegetables, candy, chocolate, cheese, noodles, eggs, etc., mixes for preparing cookies, cake or bread, frosting, pre-printed edible paper, non-printed edible paper, and sheets of gelatin. Kits may also include artistic aids such as stencils, cookie cutters, and paper towels.

In a second embodiment of the invention, there is provided a system for classifying solid, oral medicaments for identification and easy detection comprising providing means for marking solid, oral medicaments with a non-toxic, detectable marking substance which differs from the medicament in color and which is inert and physiologically acceptable. The marking means comprises at least one capillary feed marking instrument capable of producing colored indicia directly on the solid, oral medicament. The marking instrument comprises an elongated, hollow, cylindrical body having a front end and a rear end and a reservoir within the hollow cylindrical body for holding a quantity of an edible coloring liquid marking substance. A marking tip extends from the front end of the body and communicates with the reservoir for producing a colored indicia on the solid, oral medicament. A cap is removably mounted on the front end of the marking instrument to cover the marking tip when not in use. The marking tip comprises a fibrous tip which allows the edible coloring, liquid marking substance to be deposited by capillary action onto the solid, oral medicament. The coloring liquid marking substance is a non-toxic Food and Drug Administration certified dye. The viscosity and surface tension of the coloring liquid marking substance are sufficient to enable the liquid to be drawn out of the marking tip by capillary action and deposited onto the solid, oral medicament when the marking tip is contacted to the solid, oral medicament. The marking instrument is applied to the solid, oral medicament so that the marking substance leaves a detectable colored indicia on the medicament. The marked medicament is detected by detecting the color of the indicia on the medicament.

In a preferred embodiment, the system further comprises repository means for receiving and retaining a plurality of solid, oral medicaments in position for marking. The repository means comprises a device having a plurality of depressions, each of said depressions adapted to receive one of the solid, oral medicaments, and to retain the solid, oral medicament in position for marking. The depressions may be oblong or circular to accommodate medicaments of various dimensions, such as pills, tablets, or capsules.

BRIEF DESCRIPTION OF THE DRAWINGS

Reference is made to the accompanying drawings and the following detailed description. The above and other objects and features of the invention will become apparent by reference to the following detailed description taken in conjunction with the accompanying drawings, of which.

DETAILED DESCRIPTION OF THE PREFERRED EMBODIMENTS

Figure 1:
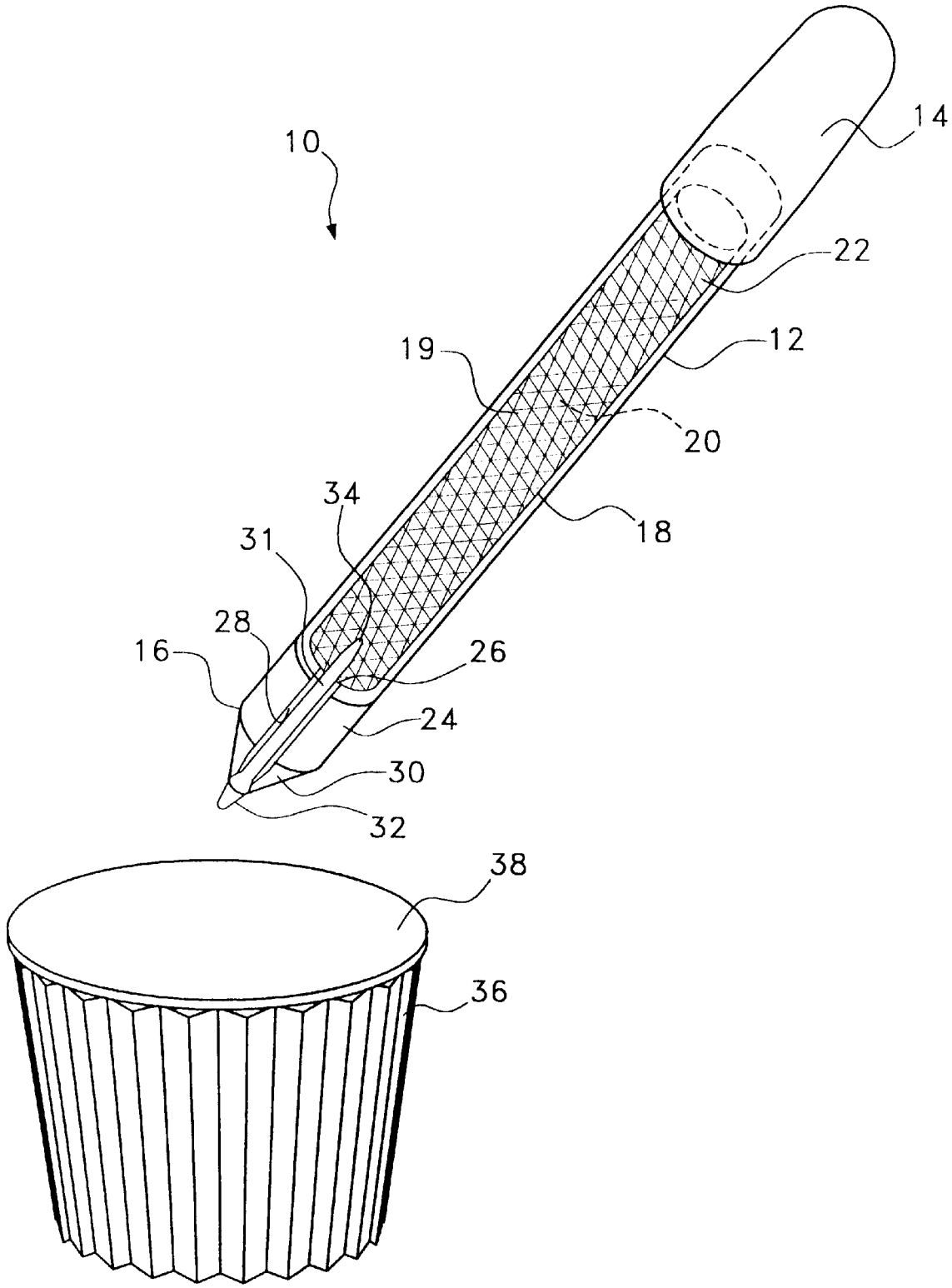
FIG. 1 is a cross-sectional view of a marking instrument in accordance with the present invention and a typical food product upon which it can be used.

Referring to FIG. 1, there is shown a capillary feed marking instrument, shown generally at 10, capable of producing colored indicia directly on a food substrate. For convenience, the following description is directed to the use of the marking instrument of the invention on a food product such as a cupcake 36, although the invention is not limited to this example.

The marking instrument 10 comprises an elongated, hollow, cylindrical body 12 having a front end and a rear end. A reservoir 18 within the hollow cylindrical body 12 holds a quantity of an edible coloring liquid 20, which is preferably water soluble. The reservoir 18 preferably comprises an absorbent fibrous filling 19.

Near the front 16 of the cylindrical body 12 there is a plug member 24 having) an aperture 26 which forms a channel 28 that extends from the inside of the cylindrical body 12 to the end of a support member 30. The support member 30 shown in FIG. 1 is frustoconical in shape but may be other shapes as known in the art.

A dispensing member, generally indicated at 31 has a marking tip 32 and extends upward in channel 28 through aperture 26 to a contacting end 34 of the dispensing member 31. Therefore, the contacting end 34 of dispensing member 31 will contact the fibrous filling 19 of reservoir 18 to allow coloring liquid 20 to flow by capillary or wicking action from reservoir 18 through the dispensing member to the marking tip 32 where it can be applied.

A cap 14 is removably mounted on the front end of the marking instrument 10 to cover the marking tip 32 when not in use to retard evaporation or drying out of the coloring liquid 20. The cap may be positioned on the back end of the marking instrument 10 as shown in FIG. 1 when the marking instrument 10 is in use.

The marking instrument 10 may be formed of any rigid material, such as plastic or metal, in accordance with known practice.

The reservoir 18 preferably comprises an absorbent fibrous filling 19 of acetate or polyester fiber, but other materials may be used as is known in the art so long as the marking instrument is capable of transferring liquid by capillary action. The fibrous filling preferably has a polypropylene covering. The fibrous filling 19 terminates in an end 22. The edible coloring liquid 20 may be injected or poured into the reservoir 18, and automatically wicks up through the fibrous filling 19 by capillary action or surface tension of the liquid to fill the fibrous filling 19 in the manner of a sponge.

Figure 2:
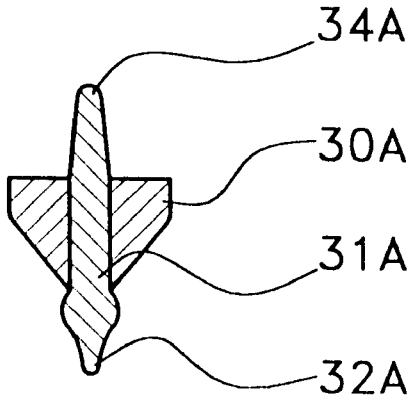
FIG. 2 is a cross-sectional view of a dispensing member and support member having a different configuration.

FIG. 2 is a cross sectional view of a dispensing member 31A having a fine point marking tip 32A and a contacting end 34A. The dispensing member 31A is mounted in frustoconical support member 30A. The marking tip 32 and 32A would be good for continuous movement of the marking instrument over the surface of the substrate whether it be porous or nonporous. The coloring liquid 20 travels from the reservoir 18 by capillary action form the contacting end 34A to marking tip 32A.

Figure 3:
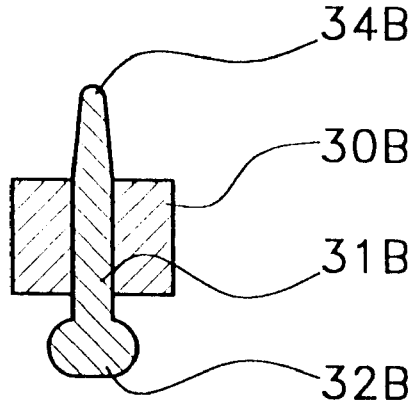
FIG. 3 is a cross-sectional views of a dispensing member and support member having an alternative configuration.

FIG. 3 is a cross-sectional view of another embodiment of the dispensing member 31B having a marking tip 32B and a contacting, end 34B. The dispensing member 31B is mounted in a support member 30B, which is cylindrical rather than frustoconical in shape, and can provide more support towards the bottom of the dispensing member 31B for the broader or specially formed marking tip 32B. Marking tip 32B could have a stamp or impression on it such as a smiley face or other device which can be used to apply coloring liquid in a predetermined design upon the contacting of the marking tip 32B to the food substrate.

The marking tip 32 is of a material suited to deploy edible coloring liquid in a controlled manner. Suitable marking tips for use in the marking markers of the invention are fibrous nibs made of felt, polyester or nylon for controlled release of the edible coloring composition.

The marking tip 32 may be shaped in a manner that at least one visible impression is transferred onto the food substrate as the marking tip is contacted to the food substrate to deposit edible coloring liquid onto the food substrate. Alternatively, the marking tip 32 may be shaped in a manner that at least one visible image is formed on the food substrate as the marking tip is moved along the surface of said food substrate to deposit edible coloring liquid onto the food substrate.

Thus, the marking tip 32 of the marking instrument 10 may be formed in any shape, such as a fine tip, broad tip, double-line tip, wavy-line tip, or a patterned tip in the shape of smiley faces, hearts, stars, or characters, etc. Such markers when used impart a unique design to the food item to be decorated.

The invention will now be described further in detail with respect to specific preferred embodiments by way of example, it being understood that these are intended to be illustrative only and the invention is not limited to the materials, procedures, amounts, etc, recited herein. All parts and percentages are by weight unless otherwise indicated.

The edible coloring composition comprises a liquid, non-toxic, odor-less, preferably water soluble, edible, food-grade dye or pigment mixed with a suitable amount of a carrier solution, preferably deionized water, which acts as a coloring fluid. The dye is non-flammable, noncombustible, substantially noncorrosive to the material comprising the marker, and inexpensive. The edible food dye employed can be of any color and meets all the requirements of the U.S. government Food and Drug Administration (FDA). These requirements are separate and distinct from other liquid requirements, such as inks and colorants, which arc not approved by the FDA for non-toxic food use. The dye is preferably a spreadable medium such as food coloring or colored food additives, or colorants for food and drugs. Alternatively, the dye may comprise liquids tinted with such dyes or colored vegetable juice or edible oil or any other suitable liquid compositions. Water, preferably deionized water, is added to dilute the coloring composition so as to obtain desired shades or colors.

Any suitable amount of the dye may be used in the marker of the invention, as will be understood by those skilled in the art, so that the dye has good chroma, color intensity and water-solubility. There should be a sufficient volume of dye in the marker so that the dye is readily substantially discharged upon demand. The dye is liquid throughout the range of normal room temperatures and pressures. By way of example, the color levels in the edible food would range from 1–10%, but concentrations both higher and lower could be employed depending upon the texture and composition of the food product to which the edible food dye is to be applied.

Preferably the edible coloring liquid comprises from about 90% to about 95% of a carrier solutions at least one edible dye in concentrations of from about 1.0% to about 10.0% by weight of the carrier solution, and at least one preservative in concentrations of from about 0.5% to 1.0% by weight of the carier solution. The viscosity and surface tension of the edible coloring liquid are sufficient to enable the liquid to be drawn out of the marking tip by capillary action and deposited onto the food substrate when the marking tip is contacted to or moved along the surface of the food substrate.

The edible coloring composition should have a decree of miscibility and viscosity in the range of from 10 to 50 cps., so that the coloring composition is a flowable substance, and easily employed With different shaped marking tips 32, 32A, 32B, regardless of the food product upon which the edible coloring composition is to be deposited. The coloring liquid is formulated to be substantially non-spreading on the selected food substrate, as the surface tension of the coloring composition is sufficient so it can be drawn out of the marking tip by capillary action, but not spread or bleed.

The dye of the invention may further contain any other suitable additive which is substantially compatible with the dye, the food item to be decorated, and components of the marker, provided that the resulting dye is remains easily dischargeable from the marker, without spreading or leaking onto the food surface. For example, the dye may be unflavored or may optionally contain a flavor matching the color of each dye, for instance, lemon for yellow, strawberry for red, etc.

The dye may also contain any compatible, non-toxic preservative or antimicrobial agent, to improve the shelf and storage life of the dye composition. Any effective amount of the additives may be used so long as the stability of the coloring composition is not adyersely affected and the composition is suitable for use in the marker of the invention for the desired end results.

Optionally, a scent may be added to the dye. By "scent" is meant any substance suitable for use in the marker and with the dyes of the invention which provides a desired scent or fragrance both during and after use. If a scent or fragrance is added, it is preferred to include a scent or fragrance that corresponds to the color of the dye or marker. Such as the scent of oranges for the orange marker, the scent of grapes for the purple-colored marker, the scent of bananas for the yellow marker, and the like.

Different coloring compositions may be prepared using food grade dyes and additives, and formulated in the form of marker dyes. From 1.0% to 10% by weight of non-toxic FDA certified food coloring dyes may be used depending on the darkness of the color desired. Amounts in excess of 10% can also be used, but the range of 1% to 10% by weight is preferred to keep costs low and to insure consistency.

In a preferred embodiment, edible coloring liquid comprises from about 90% to about 95% of a carrier solution, at least one edible dye in concentrations of from about 1.0% to about 10.0% by weight of the carrier solution, and at least one preservative in concentrations of from about 0.5% to 1.0% by weight of the canrier solution. The carrier solution is preferably selected from the group consisting of deionized water and edible alcohol, preferably ethyl alcohol. The edible dye is preferably a non-toxic Food and Drug Administration certified dye, and is preferably selected from the group consisting of FD&C Yellow #5, Yellow #6, Red #40, Blue #1, Red #3, Blue #2, Green #3, and mixtures thereof. The preservative is selected from the group consisting of sodium benzoate, phosphoric acid, benzoic acid, potassium sorbate, propylene glycol, methyl paraben and propyl paraben.

The coloring compositions can be prepared in any suitable manner, for example, by adding the dye, deionized water and at least one preservative, and optionally other additives, to a suitable vessel and mixing until a suitable solution is obtained. The final coloring composition may be filtered to remove foreign matter which may clog the nib of the marker to insure a continuous flow of the coloring liquid. The markers are then assembled singly, or in a kit for sale or use.

The invention also relates to a kit of markers of various colors. Typically, markers are sold in sets comprising a plurality of different colors for use by children and artists for coloring. The markers of the invention may be sold in kits of several markers of various hues in different combinations, such as holiday colors, valentine colors, scented, flavored, scented and flavored, or unscented and unflavored markers.

The marking instrument may be used to decorate or mark foodstuffs of various surface consistencies such as cake, cookies, biscuits, sandwiches, canapes, candy, chocolate, cheese, noodles, eggs, fruits and vegetables, and printed and non-prinited edible paper. Artistic ability is not required, particularly as the invention does not contemplate placement of stencils or copying of pre-made designs. It is envisioned that children, in particular, will enjoy using the marking instruments of the invention to decorate or simply doodle on their food.

Optionally, kits of markers may be sold in combination with other materials which promote creativity, such as with cake or cookie mixes, frosting, icing, cookie cutters, or with food items such as cookies, which may be glazed, non-printed, or preprinted with a design to be colored, vegetables, bread, chocolate, cheese or candy. Alternatively, the kits may comprise stencils which can be applied to the surface of a food, and used as an outline to be traced using the markers. It is further contemplated that the marker of the invention may be sold as part of a kit including a plurality of markers, and optionally non-printed edible paper, or pre-prinited edible paper manufactured from corn starch, carrots, etc, in the form of an edible coloring book, edible greeting cards, or stationery made of printed edible paper, which can be colored or decorated with the markers of the invention, and then consumed. The kits may optionally contain sheets of gelatin, which can be hung as light catchers after decorating with the markers of the invention. The kits can also include varieties of noodles, which can be colored and decorated and used in food crafting. The markers may be used to decorate Easter eggs and sold in combination with components of Easter egg-making kits. The markers may be used to decorate frosting and/or icing. The kits may also optionally include paper towels or wipes for use in cleaning the marker nibs following use.

At normal humidity range the coloring composition dries within seconds and is stabilized within minutes. As the coloring composition is water-soluble for the most pait, stains on the hands can be removed by merely washing with soap and water. Depending on the degree of porosity of the food item to be decorated, the coloring composition may be erased from the food item immediately after marking using a wet cloth, tissue or sponge to lift up the color. As the coloring composition is washable, it may be removed from fabric and other household surfaces, although some repeated washing may be necessary.

Refrigeration of the markers alter use is recommended to inhibit bacterial growth although the markers may be stored at temperatures between 50° F. and 90° F. The coloring compositions have a shelf life of 18–24 months if stored within the recommended parameters of temperature.

Advantageously, the marker of the invention may be used by anyone, adults or children even those with minimal artistic ability or motor skills, or lacking experience in food decorating. Using the markers of the invention, anyone can decorate a cake or other food item. The user uses the marker to draw or write directly on the food, free-hand or using a stencil as a tracing guide, if desired. The user is not limited to a particular design. As the user may create original designs, the possibilities are endless. The user may simply draw a picture, write a message on the food, or use a stencil or pre-printed design to act as a tracing (guide to copy the design onto the food using the markers of the invention, either in two-dimensional outline form, or completely colored in to give it a three-dimensional appearance. The markers are available in various colors and may be blended to provide additional colors. The markers allow users to create colorful, edible messages or works of art on food and express their creativity with no dirty mess on their hands or the food to be decorated. No bulky apparatus is required. The markers of the invention are inexpensive, easy to use, and do not require extensive storage space when not in use.

The marker of the invention allows even a small child to decorate food without directly coming into contact with messy dyes, and at the same time is inexpensive, easy to use, portable, safe, not messy, fun and entertaining. No advanced motor skills, hand coordination or artistic ability is required to use the markers. A child can express his or her creativity at any time by making colorful, one-of-a-kind designs on food, without getting all dirty and stained.

The markers may be used to write on or decorate a broad range of edible substrates including both porous and relatively non-porous surfaces, including cookies, cakes, breads, pastries, vegetables, and icing. The markers may even be used to write on whipped cream or frosting without bleeding of the coloring composition by exerting a minimum of pressure. The markers may be used to decorate sheets of gelatin, which may then be hung as light catchers, or for food crafting on food items such as eggs for Easter, noodles, cookies glazed or preprinted with designs, iced or frosted cakes, or edible paper. It is preferred to write on hard, non-porous, flat surfaces. It is possible to blend colors and to apply one color over another color to obtain a third color.

To prevent the marking tip from becoming clogged during a marking operation, and to enable continuous marking on various surfaces bearing crumbs, oil, or debris, it is advisable to wipe the marker tip on a paper towel or cloth. If the marker tip does become clogged, wiping on paper towel will dislodge the debris and effectively unclog the marking tip. Alter use, the marker tip should be wiped with a damp paper towel to remove any food or other particles adhering to the surface which can cause the tip to clog and impair proper functioning of the marker, and to prevent microbial growth.

In a second embodiment, the invention provides a means for simple, effective, marking of solid, orally ingested products such as pills, tablets and capsules, to enable monitoring of intake to ensure compliance with oral administration regimens of pharmaceuticals and nutritional products. The invention thus allows the oral medicament to be readily identified and also allows for easy visual monitoring of the intake of the medicament.

In a preferred embodiment, there is provided a system for classifying solid, oral medicaments for identification and easy detection comprising (a) providing means for marking solid oral medicaments with a non-toxic, detectable marking substance which differs from the medicament in color and which is inert and physiologically acceptable; (b) applying the marking instrument to the solid, oral medicament so that the marking substance leaves a detectable colored indicia on the medicament; and (c) detecting the marked medicament by detecting the color of the indicia on the medicament.

The marking means comprise at least one capillary feed marking instrument capable of producing colored indicia directly on the solid, oral medicament. The marking instrument comprises an elongated, hollow, cylindrical body having a front end and a rear end, a reservoir within the hollow cylindrical body for holding a quantity of an edible, water soluble, coloring liquid marking substance, a quantity of coloring liquid marking substance disposed within the reservoir, a marking tip extending from the front end and communicating with the reservoir for producing a colored mark on the solid, oral medicament, and a cap removably mounted on the front end of the marking instrument to cover the marking tip when not in use. The marking tip comprises a fibrous tip which allows the edible, water soluble, coloring liquid marking substance to be deposited by capillary action onto the solid, oral medicament substantially without bleeding. The viscosity and surface tension of the water soluble, coloring liquid marking substance are sufficient to enable the liquid to be drawn out of the marking tip by capillary action and deposited onto the solid oral medicament when the marking tip is contacted to the solid, oral medicament.

Nutritional and medicinal products, in pill, tablet or capsule form, are available in a limited variety of shapes, sizes, and colors. Frequently, users confuse such products, particularly if they are elderly and have limited vision, or are required to take such medication or supplements frequently. The consequences of taking the wrong medication can be life-threatening.

Regular intake of medication is important to its effectiveness. For example, prematurely terminating intake of antibiotics leads to re-occurrence of the disease and the development of resistance and a public health risk. Lack of compliance may cause a physician to subsequently overprescribe a medication or possibly change medications to others which may not be as effective. Nevertheless, patients often do not take their medicine regularly in accordance with their prescriptions or stop taking the medicine prematurely. There is therefor a need to reliably monitor regular intake of medication at reasonable expense. The availability of an improved method for marking oral pharmaceuticals would insure patient compliance, reduce health care costs, and improve the quality of life.

Thus, it would be very helpful if medicaments were more easily detectable. One way to more easily detect and mark such products would be to make them visible by coloring them unusual colors, and/or color-coding the various nutritional or medicinal products to be taken each day, such as blue for Sunday, red for Monday, etc.

Thus, the invention also relates to a method of encouraging self-administration of medicinal and nutritional products, referred to herein as "medicaments", comprising coloring a medicament with a non-toxic, edible, detectable substance, namely a coloring composition having a color differing from the medicament to make the product more easily visually detected using a marker of the invention. The coloring liquid marking substance is selected such that it does not affect the pharmaceutical effectiveness of the medicament or its active agent. As the coloring composition is an edible dye, it has no negative side effects in the body of the patient, is completely inert and does not affect the pharmaceutical effectiveness of the medicament's active agent while allowing easy detection of the medicament for the patient who is elderly or has poor vision. The embodiment allows the user to mark or color-code oral medicaments for easy detection using the markers of the invention. The coloring composition is physiologically acceptable to the user and has the ability to be applied to the solid surface of the nutritional or medicinal product.

Figure 4:
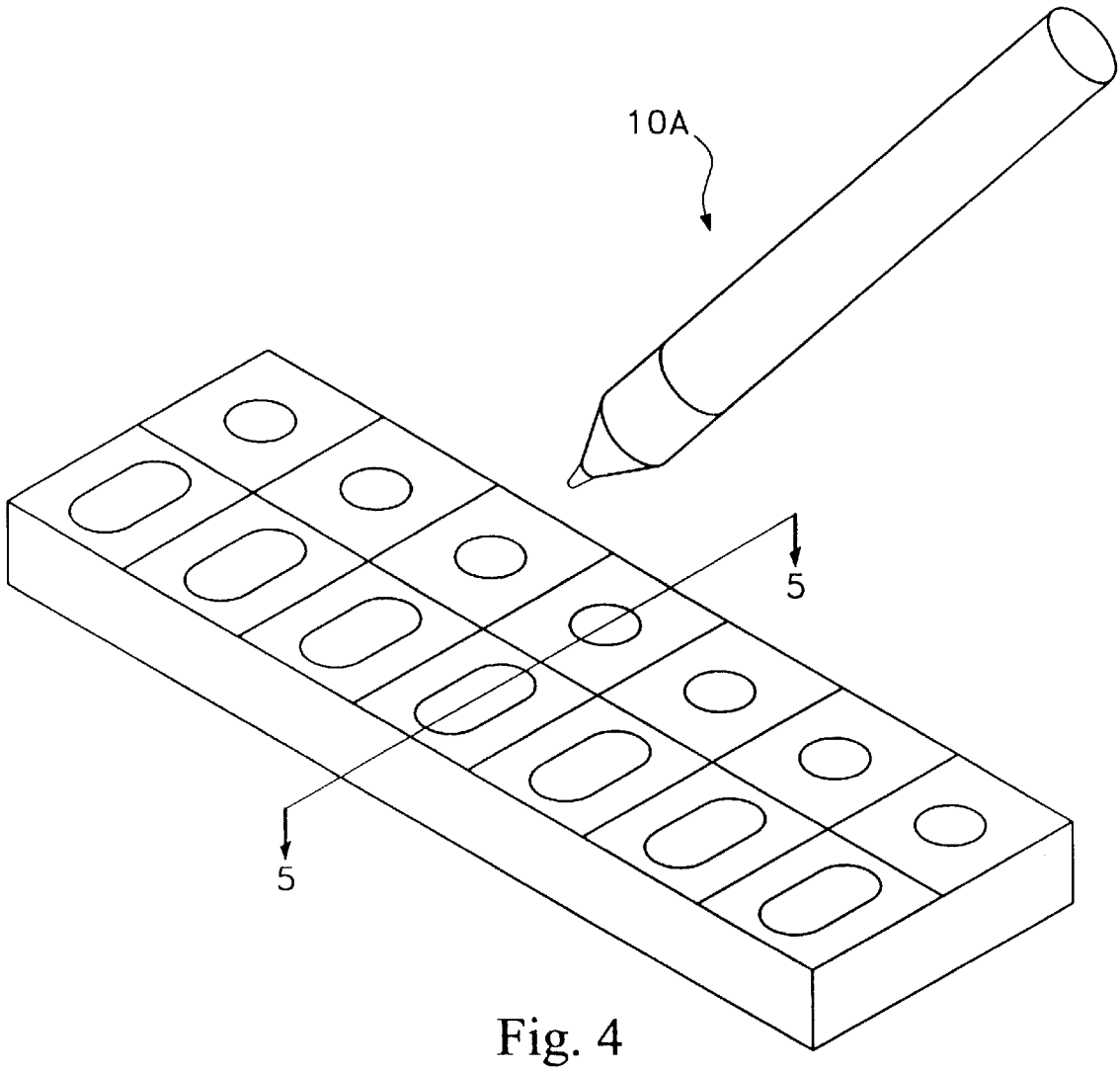
FIG. 4 is a perspective view showing a repository means for medicaments for use in accordance with the invention.
Figure 5:
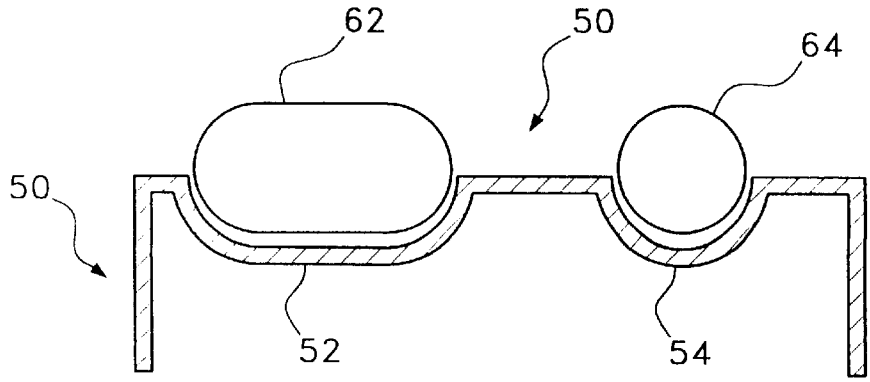
FIG. 5 is a section along line 5—5 of FIG. 4.

The system may further comprise repository means for receiving and retaining a plurality of solid oral medicaments in position for marking as illustrated in FIGS. 4 and 5. The marking device 10A shown in FIG. 4 is similar to the marking instrument 10 of FIG. 1. The repository means, indicated generally at 50 comprises a device having a plurality of depression is 592 54, each of the depressions 52, 54 adapted to receive and retain one solid, oral medicament 62, 64 in position for marking. The depressions of the repository means 50 may be oblong in shape, as shown in 52, to receive an oblong medicament such as a capsule 62, or they may be circular in shape, as shown in 54, to receive a circular medicament 64, such as a pill or tablet. Alternatively, the depressions may be configured in any other size or shape to correspond to the dimensions of the medicament. The repository means 50 may be set tip for a weekly regimen of seven medicaments or they may be made to hold any number of medicaments desired for classifying.

It will be understood that the embodiments described herein are merely exemplary and that a person skilled in the art may make many variations and modifications without departing from the spirit and scope of the invention. All such modification and variations are intended to be included within the scope of the invention as described and claimed herein.

We claim:

1. A capillary feed marking instrument capable of producing edible colored indicia directly on a food substrate, said marking instrument comprising:

an elongated, hollow, cylindrical body having a front end and a rear end a reservoir within said hollow cylindrical body for holding a quantity of an edible coloring liquid: a quantity of an edible coloring liquid disposed within said reservoir; a marking tip extending from said front end and communicating with said reservoir for producing a colored indicia on said food substrate; and a cap removably mounted on said front end of said marking instrument to cover said marking tip when not in use;

said marking tip comprising a fibrous tip which allows said edible coloring liquid to be deposited by capillary action onto said food substrate, said edible coloring liquid comprising from about 90% to about 95% of a carrier solution, at least one edible dye in concentrations of from about 1.0% to about 10.0% by weight of said carrier solution, and at least one preservative in concentrations of from about 0.5% to 1.0% by weight of said carrier solution, wherein the viscosity and surface tension of said edible coloring liquid are sufficient to enable said liquid to be drawn out of said marking tip by capillary action and easily deposited onto said food substrate when said marking tip is contacted to said food substrate.

2. 1he marking instrument of claim 1 wherein said edible dye is a non-toxic Food and Drug Administration certified dye.

3. The marking instrument of claim 2 wherein said dye is selected from the group consisting of FD&C Yellow #5, Yellow #6, Red #40, Blue #1, Red #3, Blue #2, Green #3 and mixtures thereof.

4. The marking instrument of claim 1 wherein said preservative is selected from the group consisting of sodium benzoate, phosphoric acid, benzoic acid, potassium sorbate, propylene glycol, methyl paraben and propyl paraben.

5. The marking instrument of claim 1 wherein said carrier solution is selected from the group consisting of deionized water and ethyl alcohol.

6. The marking instrument of claim 1 wherein said reservoir comprises an absorbent fibrous filling.

7. The marking instrument of claim 1 wherein said coloring liquid is preferably water soluble.

8. The marking instrument of claim 1 wherein said coloring liquid is easily deposited onto said food substrate substantially without bleeding.

9. The marking instrument of claim 1 wherein said edible coloring liquid further comprises a scent.

10. The marking instrument of claim 1 wherein said edible coloring liquid further comprises a flavoring agent.

11. The marking instrument of claim 1 wherein said marking tip is shaped in a manner that at least one visible impression is transferred onto the food substrate as the marking tip is contacted to said food substrate to deposit said edible coloring liquid onto said food substrate.

12. The marking instrument of claim 1 wherein said marking tip is shaped in a manner that at least one visible image is formed on the food substrate as the marking tip is moved along the surface of said food substrate to deposit said edible coloring liquid onto said food substrate.

13. A kit comprising a plurality of capillary feed marking instruments in a variety of colors, each of said marking instruments capable of producing different edible colored indicia directly on a food substrate, each of said marking instruments comprising an elongated, hollow, cylindrical body having a front end and a rear end, a reservoir within said hollow cylindrical body for holding a quantity of an edible coloring liquid, a quantity of an edible coloring liquid disposed within said reservoir, a marking tip extending from said front end and communicating with said reservoir for producing a colored indicia on said food substrate, and a cap removably mounted on said front end of said marking instrument to cover said marking tip when not in use, said marking tip comprising a fibrous tip which allows said edible coloring liquid to be deposited by capillary action onto said food substrate, said edible coloring liquid comprising, from about 90% to about 95% of a carrier solution, at least one edible dye in concentrations of from about 1.0% to about 10.0% by weight of said carrier solution, and at least one preservative in concentrations of from about 0.5% to 1.0% by weight of said carrier solution, wherein the viscosity and surface tension of said edible coloring liquid are sufficient to enable said liquid to be drawn out of said marking tip by capillary action and deposited onto said food substrate when said marking tip is contacted to said food substrate.

14. The marking instrument of claim 13 wherein said edible dye is a non-toxic Food and Drug Administration certified dye.

15. The marking instrument of claim 13 wherein said dye is selected from the group consisting of FD&C Yellow #5, Yellow #6, Red #40, Blue #1, Red #3, Blue #2, Green #3 and mixtures thereof.

16. The marking instrument of claim 13 wherein said preservative is selected from the group consisting of sodium benzoate, phosphoric acid, benzoic acid, potassium sorbate, propylene glycol, methyl paraben and propyl paraben.

17. The marking instrument of claim 13 wherein said carrier solution is selected from the group consisting of deionized water and ethyl alcohol.

18. The marking instrument of claim 13 wherein said reservoir comprises an absorbent fibrous filling.

19. The marking instrument of claim 13 wherein said coloring liquid is preferably water soluble.

20. The marking instrument of claim 13 wherein said coloring liquid is easily deposited onto said food substrate substantially without bleeding.

21. The marking instrument of claim 13 wherein said edible coloring liquid further comprises a scent.

22. The marking instrument of claim 13 wherein said edible coloring liquid further comprises a flavoring agent.

23. The marking instrument of claim 13 wherein said marking tip is shaped in a manner that at least one visible impression is transferred onto the food substrate as the marking tip is contacted to said food substrate to deposit said edible coloring liquid onto said food substrate.

24. The marking instrument of claim 13 wherein said marking tip is shaped in a manner that at least one visible image is formed on the food substrate as the marking tip is moved along the surface of said food substrate to deposit said edible coloring liquid onto said food substrate.

25. The kit of claim 13 further comprising at least one edible substance, said edible substance selected from the group consisting of non-printed cookies, pre-printed cookies, fruits, vegetables, candy, chocolate, cheese, noodles, eggs, mixes for preparing cookies, cake or bread, frosting, pre-printed edible paper, non-printed edible paper, sheets of gelatin, and mixtures thereof.

26. The kit of claim 13 further comprising at least one artistic aid, said artistic aid selected from the group consisting of stencils, cookie cutters, and paper towels.

27. A system for classifying solid, oral medicaments for identification and easy detection comprising:

a. providing means for marking solid, oral medicaments with a non-toxic, detectable marking substance which differs from said medicament in color and which is inert and physiologically acceptable, said means comprising at least one capillary feed marking instrument capable of producing colored indicia directly on said solid, oral medicament, said marking instrument comprising an elongated, hollow, cylindrical body having a front end and a rear end, a reservoir within said hollow cylindrical body for holding a quantity of an edible coloring liquid marking substance, a quantity of an edible coloring liquid marking substance disposed within said reservoir, a marking tip extending from said front end and communicating with said reservoir for producing a colored indicia on said solid, oral medicament, and a cap removably mounted on said front end of said marking instrument to cover said marking tip when not in use, said marking tip comprising a fibrous tip which allows said edible coloring liquid marking substance to be deposited by capillary action onto said solid, oral medicament, said edible coloring liquid comprising from about 90% to about 95% of a carrier solution. at least one edible dye in concentrations of from about 1.0% to about 10.0% by weight of said carrier solution, and at least one preservative in concentrations of from about 0.5% to 1.0% by weight of said carrier solution, wherein the viscosity and surface tension of said edible coloring liquid marking substance are sufficient to enable said liquid to be drawn out of said marking tip by capillary action and deposited onto said solid, oral medicament when said marking tip is contacted to said solid, oral medicament;

b. applying said marking instrument to said solid, oral medicament so that said marking substance leaves a detectable colored indicia on said medicament, and c. detecting said marked medicament by detecting the color of said indicia on said medicament.

28. The system of claim 27 wherein said solid, oral medicament is a nutritional or medicinal compound.

29. The system of claim 27 wherein said edible dye is a non-toxic Food and Drug Administration certified dye.

30. The system of claim 27 wherein said dye is selected from the group consisting of FD&C Yellow #5, Yellow #6, Red #40, Blue #1, Red #3, Blue #2, Green #3 and mixtures thereof.

31. The system of claim 27 wherein said preservative is selected from the group consisting of sodium benzoate, phosphoric acid, benzoic acid, potassium sorbate, propylene glycol, methyl paraben and propyl paraben.

32. The system of claim 27 wherein said carrier solution is selected from the group consisting of deionized water and ethyl alcohol.

33. The system of claim 27 wherein said reservoir comprises an absorbent fibrous filling.

34. The system of claim 27 further comprising, after step a., the step of placing a defined number of medicaments in a repository means for receiving, and retaining a plurality of solid, oral medicaments in position for marking.

35. The system of claim 27 wherein said repository means comprises a device having a plurality of depressions, each of said depressions adapted to receive one of said solid, oral medicaments, and to retain said solid, oral medicament in position for marking.

36. A kit for classifying solid oral medicaments for identification and easy detection comprising a plurality of capillary feed marking instruments capable of producing colored indicia directly on solid, oral medicaments with a non-toxic, detectable marking substance which differs from said medicaments in color and which is inert and physiologically acceptable, and repository means for receiving and retaining a plurality of solid, oral medicaments in position for marking, each of said marking instruments comprising an elongated, hollow cylindrical body having a front end and a rear end, a reservoir within said hollow cylindrical body for holding a quantity of an edible coloring liquid marking substance, a quantity of an edible coloring liquid marking substance disposed within said reservoir, a marking tip extending from said front end and communicating with said reservoir for producing a colored indicia on said solid, oral medicament, and a cap removably mounted on said front end of said marking instrument to cover said marking tip when not in use, said marking tip comprising a fibrous tip which allows said edible coloring liquid marking substance to be deposited by capillary action onto said solid, oral medicament, said edible coloring liquid comprising from about 90% to about 95% of a carrier solution, at least one edible dye in concentrations of from about 1.0% to about 10.0% by weight of said carrier solution, and at least one preservative in concentrations of from about 0.5% to 1.0% by weight of said carrier solution, wherein the viscosity and surface tension of said edible coloring liquid marking substance are sufficient to enable said liquid to be drawn out of said marking tip by capillary action and deposited onto said solid, oral medicament when said marking tip is contacted to said solid, oral medicament.

37. The kit of claim 36 wherein said solid, oral medicament is a nutritional or medicinal compound.

38. The kit of claim 36 wherein said edible dye is a non-toxic Food and Drug Administration certified dye.

39. The kit of claim 36 wherein said dye is selected from the group consisting of FD&C Yellow #5, Yellow #6, Red #40, Blue #1, Red #3, Blue #2, Green #3 and mixtures thereof.

40. The kit of claim 36 wherein said preservative is selected from the group consisting of sodium benzoate, phosphoric acid, benzoic acid, potassium sorbate, propylene glycol, methyl paraben and propyl paraben.

41. The kit of claim 36 wherein said carrier solution is selected from the group consisting of deionized water and ethyl alcohol.

42. The kit of claim 36 wherein said reservoir comprises an absorbent fibrous filling.

43. The kit of claim 36 wherein said repository means comprises a device having a plurality of depressions, each of said depressions adapted to receive one of said solid, oral medicaments, and to retain said solid, oral medicament in position for marking.

44. A method of directly marking a food substrate comprising a. providing a capillary feed marking instrument capable of producing edible colored indicia directly on a food substrate, said marking instrument comprising:

an elongated, hollow, cylindrical body having a front end and a rear end; a reservoir within said hollow cylindrical body for holding a quantity of an edible coloring liquid; a quantity of an edible coloring liquid disposed within said reservoir; a marking tip extending from said front end and communicating with said reservoir for producing a colored indicia on said food substrate; and a cap removably mounted on said front end of said marking instrument to cover said marking tip when not in use, said marking tip comprising a fibrous tip which allows said edible coloring liquid to be deposited by capillary action onto said food substrate, said edible coloring liquid comprising from about 90% to about 95% of a carrier solution, at least one edible dye in concentrations of from about 1.0% to about 10.0% by weight of said carrier solution, and at least one preservative in concentrations of from about 0.5% to 1.0% by weight of said carrier solution, wherein the viscosity and surface tension of said edible coloring liquid are sufficient to enable said liquid to be drawn out of said marking tip by capillary action and easily deposited onto said food substrate when said marking tip is contacted to said food substrate, and b. contacting said marking instrument to said food substrate to deposit edible colored indicia directly on said food substrate.

45. A method of directly marking a solid, oral medicament comprising a. providing means for marking a solid, oral medicament with a non-toxic, detectable marking substance which differs from said medicament in color and which is inert and physiologically acceptable, said means comprising at least one capillary feed marking instrument capable of producing colored indicia directly on said solid, oral medicament, said marking instrument comprising an elongated, hollow, cylindrical body having a front end and a rear end, a reservoir within said hollow cylindrical body for holding a quantity of an edible coloring liquid marking substance, a quantity of an edible coloring liquid marking substance disposed within said reservoir, a marking tip extending from said front end and communicating with said reservoir for producing a colored indicia on said solid, oral medicament, and a cap removably mounted on said front end of said marking instrument to cover said marking tip when not in use, said marking tip comprising a fibrous tip which allows said edible coloring liquid marking substance to be deposited by capillary action onto said solid, oral medicament, said edible coloring liquid comprising from about 90% to about 95% of a carrier solution, at least one edible dye in concentrations of from about 1.0% to about 10.0% by weight of said carrier solution, and at least one preservative in concentrations of from about 0.5% to 1.0% by weight of said carrier solution, wherein the viscosity and surface tension of said edible coloring liquid marking substance are sufficient to enable said liquid to be drawn out of said marking tip by capillary action and deposited onto said solid, oral medicament when said marking tip is contacted to said solid, oral medicament; and b. contacting the marking tip of said marking instrument to said solid, oral medicament so that said marking substance leaves a detectable colored indicia on said medicament.

* * * * *